US005574203A

United States Patent [19]

Noel et al.

[11] Patent Number: 5,574,203

[45] Date of Patent: Nov. 12, 1996

[54] PROCESS AND INSTALLATION FOR DESTROYING MUNITIONS CONTAINING TOXIC AGENTS

[75] Inventors: Nicolas Noel, Paris; Yves Santo, Le Plessis Trevise, both of France

[73] Assignee: Snpe Ingenierie S.A., Saint Quentin En Yvelines, France

[21] Appl. No.: 329,854

[22] Filed: Oct. 27, 1994

[51] Int. Cl.[6] ..... A62D 3/00

[52] U.S. Cl. ..... 588/203; 149/124; 264/31; 110/237; 110/242; 422/129

[58] Field of Search ..... 588/203; 149/124; 264/3.1; 110/237, 242; 422/129

[56] References Cited

U.S. PATENT DOCUMENTS

| | | | |
|---|---|---|---|
| 3,897,237 | 7/1975 | Musselman et al. | 588/202 |
| 4,758,387 | 7/1988 | Sayles | 264/3.1 |
| 4,858,833 | 8/1989 | Hanulik | 241/24 |
| 5,458,071 | 10/1995 | Tadmor et al. | 110/237 |

FOREIGN PATENT DOCUMENTS

| | | |
|---|---|---|
| 001526 | 4/1979 | European Pat. Off. . |
| 3913479 | 8/1990 | Germany . |
| 4115435 | 8/1992 | Germany . |

*Primary Examiner*—Ngoclan Mai

*Attorney, Agent, or Firm*—Cushman Darby & Cushman, LLP

[57] ABSTRACT

The invention relates to a process and an installation for destroying munitions containing toxic agent. The process comprises equipping the munitions with a pyrotechnic fragmentation device and submerging in a pool which is filled with a liquid for neutralizing the toxic agent, closing the pool with a lid so that the pool is sealed with respect to toxic emanation, and igniting the pyrotechnic device so that the munitions is fragmented and releases the toxic agent into the pool. After the fragmentation of the munitions is neutralized with the neutralizing liquid, the pool is reopened for another cycle of destruction. The advantage is of completely destroying the munitions in a single operation cycle without the risk of contamination. The invention is applicable to the destruction of munitions containing chemical or bacteriological toxic agents.

12 Claims, 1 Drawing Sheet

PROCESS AND INSTALLATION FOR DESTROYING MUNITIONS CONTAINING TOXIC AGENTS

The present invention lies within the field of munitions containing chemical or bacteriological toxic agents. Its object is to propose a process and an installation for destroying such munitions, which process and installation are satisfactory for the safety of the personnel and the environment.

BACKGROUND OF THE INVENTION

Among munitions there are many of small and medium size. These are, for example, shell, rocket, small missile warheads,. They comprise, in various casings, generally made of metal:

a charge of chemical or bacteriological toxic agent, a pyrotechnic dispersal charge, an initiation system which initiates the explosion of the pyrotechnic dispersal charge and brings about the fragmentation of the munition and the dispersal of the toxic agent.

The initiation system is, for example, of the percussion fuse or the proximity fuse type. During the storage of the munitions, the initiation system is not fitted on the munition.

These munitions may also be of larger size: these are, for example, bombs or larger missile warheads. In this case, the pyrotechnic dispersal charge is of greater mass than for the aforementioned munitions.

We will use the general term munition in the text except where particular points need to be stressed.

The munitions may be in a good state but voluntarily decommissioned, or more or less damaged according to their "age" and the storage conditions and therefore be necessarily decommissioned.

The chemical toxic agents are among those known under the name of "poison gases" and are characterized by their suffocating, vesicant, haemotoxic or neurotoxic action.

We will mention among suffocating gases, chlorine and phosgene ($COCl_2$); among vesicant agents, yperite (dichloroethylsulphide $S(CH_2–CH_2Cl)_2$, lewisite. We will also mention other organo-phosphorous compounds such as sarin (GB agent, $(CH_3)_2CHOP\ (CH_3)\ (O)\ F$), tabun (GA agent, $(CH_3)_2NP\ (OCH_{2CH3})\ (O)\ CN$), soman (GD agent, $(CH_3)_3CCH\ (CH_3)OP\ (CH_3)\ (O)\ F$).

The bacteriological toxic agents are much less well known, but microbial or vital strains are used.

By destruction of the munitions, we mean the destruction of the containers and the contents: that is to say the destruction of the pyrotechnic dispersal charge, the destruction (or detoxification) of the charge of toxic agent, and finally the destruction of the casings which contain these charges and of the "structure" of the munition so that they can be scrapped or recycled after decontamination.

In an adjoining field, that of the treatment of hazardous industrial waste stored in barrels, mention may be made of the process described in Patent EP 13 822, in which the barrels are mechanically destroyed in a liquid treatment medium which neutralizes or modifies the said waste, the residue of which is then solidified and dumped.

The process known to date for destroying munitions consist in dismantling the munition into its elements, in recovering the toxic agent in suitable containers in order then to destroy the said toxic agent in specific installations, for example by neutralization or incineration in special furnaces (see, for example, U.S. Pat. No. 4,666,696). The pyrotechnic dispersal charge, separated from the munition is destroyed, moreover, by burning or blasting. Finally, the various casings and the structure of the munition are decontaminated before being scrapped or recycled.

The drawbacks of such a set of processes are numerous: a multitude of delicate operations on the munition which take place, moreover, in different specific installations, with transfers from one site to another. All this multiplies the risks as regards the personnel and the environment. All these drawbacks are aggravated when the munitions are in a poor state, which is frequently the case following long storage under poor conditions.

It should also be noted, as another drawback, that such a set of processes does not lend itself to the rapid destruction of a great number of munitions in a short space of time.

The problem is of having available a process and an installation for destroying the munitions containing toxic agents in a reduced number of operations, on a single site, and this being under conditions of safety which are satisfactory for the personnel and the environment. Another problem is of having available a process and an installation which lend themselves to high throughputs of destruction.

SUMMARY OF INVENTION

The present invention relates to a process for destroying, in a pool, a munition containing a toxic agent and equipped with a pyrotechnic fragmentation device, the pool being filled with a liquid neutralizing the toxic agent, being resistant to explosions, and including a lid, characterized in that the following cycle of operations is carried out:

the said pool is closed so that it is sealed with respect to toxic emanations, the pyrotechnic device is ignited, the fragmentation of the munition releasing the toxic agent into the neutralizing liquid, after the duration of neutralization of the toxic agent, the pool is reopened for another cycle of destruction.

DETAILED DESCRIPTION OF INVENTION

The toxic emanations are the toxic agent released, when the munition is fragmented, in the form, for example, of a gas, liquid or aerosol.

The pool and its lid which is sealed with respect to emanations, withstand the effects of the explosion.

Preferentially, the pyrotechnic device for fragmenting the munition makes use of the pyrotechnic dispersal charge of the said munition, complemented by at least one detonator for initiating the operation of this pyrotechnic dispersal charge.

In the particular cases where the munition to be destroyed does not have a pyrotechnic dispersal charge, the pyrotechnic fragmentation device comprises at least one initiation detonator and one cutting cord located on the munition to create at least one opening in the munition so as to disperse the toxic agent into the neutralizing liquid in the pool and allow the said neutralizing liquid to enter inside the munition.

These particular cases are those, especially, of munitions initially including a pyrotechnic dispersal charge of significant mass, which pyrotechnic charge has been dismantled in a preliminary operation; this precaution avoids using installations of an excessive size for implementing the process.

The whole of the pyrotechnic fragmentation device and the firing line to which it is connected must withstand immersion (leaktightness and corrosion) for a space of time greater than the performance of a cycle of destruction.

In this process the fragments of the munitions destroyed are recovered after several cycles of destruction.

In a particular embodiment, the fragments of the munitions destroyed are gathered in a receptacle placed at the bottom of the pool. This receptacle, with associated handling means, serves to recover the said fragments after several cycles of destruction.

Advantageously, the space lying between the lid of the pool and the free surface of the neutralizing liquid in the pool is doused down with liquid neutralizing the toxic agent. Preferentially, the said dousing down takes place in closed circuit with the neutralizing liquid in the pool. This dousing-down operation takes place during at least the entire duration of the neutralization of the toxic agent.

The neutralizing liquid in the pool is agitated for at least all of the duration of neutralization of the toxic agent, to ensure, on the one hand, homogenization of the liquid and to ensure, on the other hand, rinsing and decontamination of the fragments of the munitions destroyed. This agitation thus prevents decantation of some effluents and prevents them from concentrating at various points in the pool. The effluents are the products resulting from the reaction of the toxic agent with the neutralizing agent in the pool; these effluents are in solution or suspension in the said neutralizing liquid.

Preferentially, the liquid neutralizing the toxic agent is water-based. If necessary basic or alkaline products such as sodium hydroxide, potassium hydroxide or other compounds promoting the neutralization reaction of the chemical or bacteriological toxic agent are added to the water.

The excess of neutralizing liquid and its agitation by suitable devices, and also by the effects of the explosion, contribute to increasing the kinetics for neutralizing the toxic agent.

The neutralizing liquid in the pool is periodically checked, when it is saturated with effluent the pool is drained and the neutralizing liquid is renewed, the effluents being treated by suitable methods, particularly concentration and incineration methods.

The present invention also relates to an installation for destroying munitions containing a toxic agent and equipped with a pyrotechnic fragmentation device. The installation comprises a pool filled with a liquid neutralizing the said toxic agent, resistant to explosions, and including a lid, characterized in that the said lid is equipped with at least one access hatch which is sealed with respect to toxic emanations. The sealed lid contains the emanations, more particularly that fraction of toxic agent which is entrained, in the form of a gas, aerosol or liquid, by the gas bubble and the surface shower which are created by the explosion. Preferentially, the said lid includes an opening which is closed in a sealed fashion by a cover.

Advantageously, the pool includes at least one device for dispersing a neutralization liquid, emerging above the free surface of the neutralizing liquid. This dispersing device douses down the gaseous volume lying between the lid of the pool and its free surface in order to neutralize the toxic agent released by the fragmentation of the munition, in the form of a liquid, gas, or aerosol. This dispersing device also douses down all the walls in order to decontaminate them.

Preferentially, the dispersing device operates in closed circuit with the neutralizing liquid in the pool.

Preferentially also, the pool includes at least one device for agitating the neutralizing liquid and make it flow through the fragments of the munitions destroyed.

The pool includes, at the bottom part, deflectors which guide the fragments of the munitions destroyed towards a receptacle placed at the bottom of the pool.

The angle of inclination of the deflectors is such that the fragments of the munitions destroyed slide over these deflectors under the action of their weight, without remaining stuck on them by the effect of friction.

In a particular embodiment, the bottom of the pool is frustoconical and, at its bottom part, exhibits a depression in which the said receptacle for recovering the fragments of the munitions destroyed is housed, the frustoconical shape of the bottom of the pool acts as the deflectors.

The pool itself is placed in a building which is sealed with respect to emanations, and sized so as to withstand accidental explosion during handling of the pyrotechnic device for fragmenting the munition. This building communicates with at least one preparation line comprising a preparation workshop in which the munition to be destroyed is equipped with the pyrotechnic fragmentation device; with this workshop are associated stores of munitions to be destroyed, and of initiation devices necessary for producing a series of cycles of destruction, which will also be denoted by the term firing.

Advantageously, the pool is associated with two preparation lines: during one firing in the pool, the next munition is prepared in the preparation workshop of the other preparation line.

The installation also includes a control and firing station: it is equipped with viewing ports or a video system allowing the building of the pool to be monitored. The displacements of the munition transporter, as well as those of the lid for the sealed closure of the pool are controlled remotely.

Thus, the only direct interventions of the operators on the munition are the laying of the munition on the transporter, and the fitting of the fragmentation initiation device (detonators and/or cutting cord); the other operations are carried out remotely.

The advantages of the process and of the installation, which combine pyrotechnics and chemical or bacteriological neutralization, are connected with the destruction which takes place in a single cycle of operation on one and the same site. This destruction is complete: the pyrotechnic dispersal charge, the charge of toxic agent, the casings and the structure of the munition are simultaneously destroyed. This destruction takes place under conditions of safety which are satisfactory for the operators, because their interventions on the munition itself are reduced to a limited number of operations. The safety as regards the environment is also satisfactory because the operations take place in buildings and installations which are sealed with respect to the effluents and dimensioned in order to withstand intentional or accidental explosions.

This process and this installation also lend themselves to carrying out the destruction of munitions with high throughputs in order rapidly to treat a great number of munitions.

The invention is explained in more detail below with the aid of the figures representing a particular embodiment.

Figure 1:
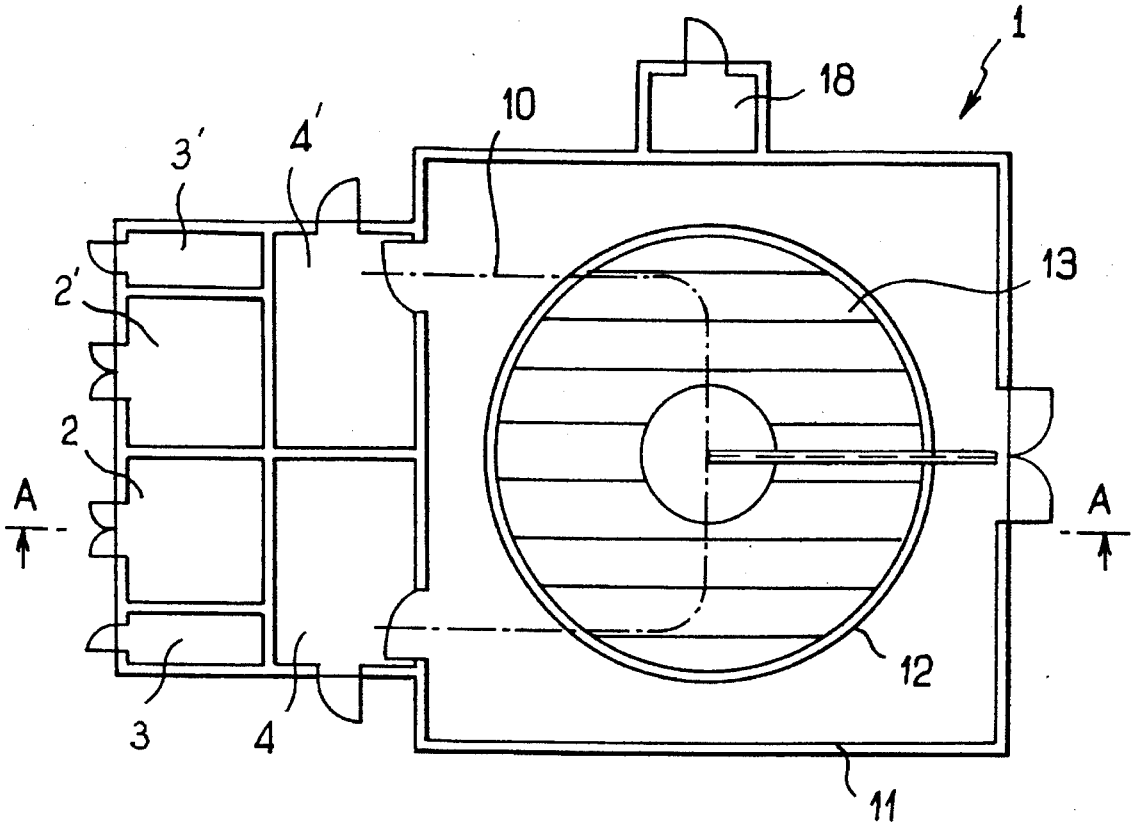
FIG. 1 represents a diagrammatic plan view of the destruction installation including the pool and the auxiliary buildings.
Figure 2:
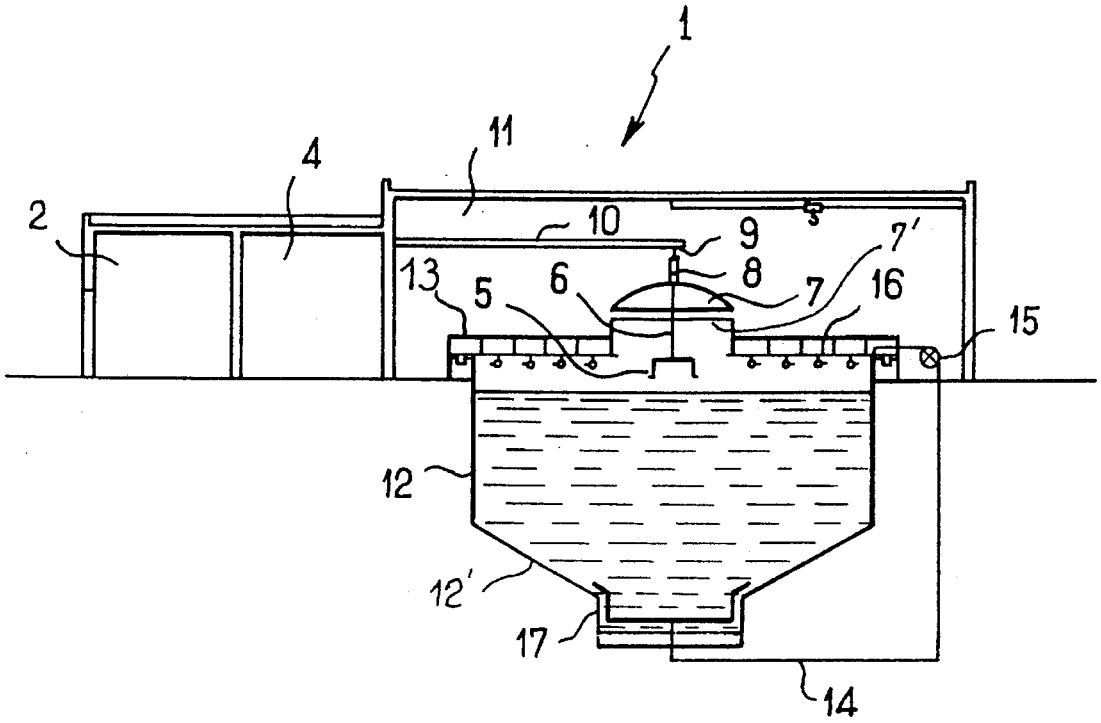
FIG. 2 represents a diagrammatic sectional view of the pool and of the buildings.

Before implementation of the process according to the invention, the munitions to be destroyed are gathered together and transported to the work site. Very defective munitions which could exhibit leaks are placed in sealed containers, the operators wear suitable protective suits during this phase.

On the work site, the munitions are identified and classified. One set of munitions representing the activity of a day's work or the maximum permissible load in the buildings is placed in the store 2 of munitions to be destroyed, of one preparation line of the installation 1.

The operator takes, from the store 2, a munition to be destroyed, and brings it into the preparation workshop 4: transfer takes place manually or with the aid of a handling truck. He then fixes the said munition onto a support 5, the cradle shape of which is designed for the dimensions of the munition. This support is possibly consumable in order to take account of the damage to which the fragmentation of the munition gives rise, and thus prevent operations of checking, decontaminating, and repair before each re-use: the support is treated like the fragments of the munition. This support 5 is fastened under the closure cover 7 of the pool 12 by a telescopic arm 6. This cover 7 itself is suspended from a thrust cylinder 8 under the transporter truck 9 of a monorail 10. This thrust cylinder 8 serves to lower or raise the cover 7. Like the telescopic arm 6, it is controlled remotely.

A pyrotechnist takes, from the store 3, an initiation device and places it on the munition. This device comprises at least one detonator when the munition to be destroyed comprises a pyrotechnic dispersal charge, and at least one detonator associated with at least one cutting cord when the munition does not have the said dispersal charge. The pyrotechnist connects the detonator to a firing line connected up to a sealed passage located on the cover 7 and, from there connected to the control station 18. The transporter 9 is then transferred into the building 11, where the pool 12 is to be found, above the centre of the pool 12, these operations are controlled remotely. The pyrotechnist verifies the continuity of the firing line then controls the lowering, by the thrust cylinder 8, of the munition into the pool, and of the cover 7, as well as the closure of the latter using suitable automatons, sealing as regards toxic emanations being provided by seals.

The device 16 for dispersing, and the device 14, 15, 16 for agitating the neutralizing liquid are started up. The pyrotechnist, after safety checks, from the control station 18, proceeds with the firing. The fragmentation of the pyrotechnic charge disperses the toxic agent into the neutralizing liquid, the fragments of the munition are slowed by the liquid and fall towards the bottom of the pool and are directed by the deflectors, here produced by the frustoconical shape 12' of the bottom of the pool 12, to the receptacle 17 intended to receive them. The gas bubble which accompanies the explosion bursts at the surface, releasing part of the toxic products into the atmosphere lying between the free surface of the pool 12 and its lid 13. The dousing-down and agitation are maintained for a sufficient time to ensure neutralization of the toxic agent released. After they have been shut down the pool is reopened and the thrust cylinder 8 raises the cover 7. The pool is ready to recommence the next cycle of destruction with the elements coming from the other preparation line (stores 2', 3' and workshop 4').

The dispersing or dousing-down device 16 consists, for example, of a set of hoses equipped with calibrated perforations orientated so that they douse down the entire volume lying between the lid and the free surface of the neutralizing liquid, and all the surfaces and more particularly the internal part of the cover. This device is supplied by pumps 15 which take up the neutralizing liquid from various points 14 of the pool 12, in order not to complicate the figure just one circuit is represented therein. The agitating device 14, 15, 16 is here produced by the recirculation of the neutralizing liquid. The pumps 15 take up the neutralizing liquid from various points 14 of the bottom of the pool and supply the dispersing device 16, and possibly various injection points on the walls of the pool, carefully placed to ensure recirculation currents. It should be noted that the effects of the explosion: bursting of the gas bubble, the surface shower and the swirls which follow it, also contribute to this agitation.

The fragments, gathered in the receptacle 17, are removed from the pool at the end of a certain number of cycles of destruction. An auxiliary handling device serves to remove the receptacle 17, in order to unload the fragments. After checking, the fragments are treated like ordinary waste which is either scrapped or recycled.

When the neutralizing liquid in the pool 12 is saturated with effluents, the liquid is evacuated by pumping to a treatment tank, the effluents and residue of which are treated by suitable means.

The installation 1 comprises two stores 2, 2' of munitions to be destroyed, two stores of initiation devices 3, 3' two preparation workshops 4, 4' communicating with a building 11 in which the pool 12 is to be found. The said pool 12 includes a lid 13, produced by sealed decking resistant to explosions; an opening 7' made in this lid is closed so that it can be sealed as regards toxic emanations, by a cover 7; this cover 7 fastens under the transporter truck 9 of a monorail 10, the transporter 9 makes it possible to bring the said cover into the preparation workshops 4 or 4'.

The two independent and parallel preparation lines (premises 2, 3, 4 and 2', 3', 4') make it possible, when a firing is being carried out in the pool, to prepare the next firing on the other line. Independently of the time savings, this arrangement prevents the pool from being out of service if one of the lines is not available.

The pool 12 is hollowed out from compact and stable ground. Its bottom is lined with concrete and the wall is produced from a ductile material which withstands the pressure wave well and which, associated with compact external ground, gives the whole assembly good stability. The sealing of the pool, at the walls and ground level is provided by a flexible and tearproof coating and it is regularly monitored to prevent risks of pollution of the environment, that is to say of the ground and of the groundwater table.

The pool and its lid are dimensioned to contain the effects due to the explosion of the maximum charge of the munitions to be destroyed, this dimensioning also takes into account the magnitude of the stresses due to the repeated firings. For example, for the explosion of a maximum charge of 2kg of explosive, such as TNT (trinitrotoluene) the pool must have a diameter of approximately 12 metres, contain a height of 6 metres of liquid, the munition to be destroyed being submerged at approximately half depth. For dispersal charges of greater mass, installations of greater dimensions would, of course, be required, hence the benefit in the process of limiting the mass of the fragmentation charge by dismantling the dispersal charge when its mass is too great.

The dousing-down device 16 and the agitating device 14, 15, 16 are, themselves, designed and possibly protected, to withstand the effects of repeated explosions.

Finally, all of the buildings containing the pool 12 and the stores (2, 3, 2' and 3'), the preparation workshops, are designed and dimensioned to contain the mechanical effects (blast and fragments) and the toxic effects (dispersal of the toxic agent) due to an accidental fragmentation of the munition. In particular, the atmosphere of these premises is checked and partially treated by a bubbling through the neutralizing liquid in the pools; air locks (not represented in the figures) are provided for the access to the various buildings.

We claim:

1. In a process for destroying a munition containing a toxic agent in a pool which is filled with a neutralizing liquid for the toxic agent, the pool also being resistant to explosions and including lid means for closing the pool to seal against toxic emanations, the process comprising the following cycle of operations:

(1) equipping the munition with a pyrotechnic fragmentation device;

(2) introducing the munition into the pool;

(3) closing said pool so that the pool is sealed with respect to toxic emanation;

(4) igniting the pyrotechnic device so that the munition is fragmented and releases the toxic agent into the neutralizing liquid;

(5) permitting the neutralizing liquid to neutralize the toxic agent; and (6) reopening the pool after neutralization of the toxic agent for another cycle.

2. Process according to claim 1 which comprises using, as the pyrotechnic fragmentation device, one comprising a pyrotechnic dispersal charge of the munition complemented by at least one initiation detonator.

3. Process according to claim 1 which comprises using, as the pyrotechnic fragmentation device, one which comprises at least one initiation detonator and one cutting cord located on the munition.

4. Process according to claim 1 which includes the step of recovering the fragments of the destroyed munitions after several cycles of operation.

5. Process according to claim 4 wherein the fragments are recovered in a receptacle placed at the bottom of the pool.

6. Process according to any one of claims 1 to 3 comprising the step of dousing down with liquid neutralizing the toxic agent, the space lying between the lid means for closing the pool and the surface of the neutralizing liquid in the pool.

7. Process according to any one of claims 1 to 3 comprising the step of agitating the neutralizing liquid in the pool during neutralization of the toxic agent.

8. An installation for destroying munitions containing a toxic agent and equipped with a pyrotechnic fragmentation device, said installation comprising a pool filled with a liquid for neutralizing said toxic agent, said pool being resistant to explosion and including lid means for sealing said pool against toxic emanation from said pool, said lid means also including at least one access hatch for access to said pool.

9. An installation according to claim 8 comprising means for dispensing neutralization liquid above the surface of neutralizing liquid in the pool.

10. An installation according to claim 9, wherein the dispensing means operates in a closed circuit for circulating the neutralizing liquid in the pool.

11. An installation according to claim 8 wherein the pool also includes at least one device for agitating neutralizing liquid within the pool.

12. An installation according to claim 8, comprising two independent preparation lines for preparing the munition for destruction and transporting the munition from preparation to the pool.

* * * * *